US005765969A

United States Patent [19]

Kåreby et al.

[11] Patent Number: 5,765,969

[45] Date of Patent: Jun. 16, 1998

[54] TUBEFORMED ROCK BOLT

[75] Inventors: Björn Kåreby, Skärholmen; Anita Mandal, Solna, both of Sweden

[73] Assignee: Atlas Copco Rock Drill AB, Stockholm, Sweden

[21] Appl. No.: 737,779

[22] PCT Filed: Jun. 1, 1995

[86] PCT No.: PCT/SE95/00608

§ 371 Date: Nov. 25, 1996

§ 102(e) Date: Nov. 25, 1996

[87] PCT Pub. No.: WO95/33916

PCT Pub. Date: Dec. 14, 1995

[30] Foreign Application Priority Data

Jun. 2, 1994 [SE] Sweden ..... 9401894

[51] Int. Cl.[6] ..... E21D 20/00

[52] U.S. Cl. ..... 405/259.3; 405/259.1; 411/19

[58] Field of Search ..... 405/259.1, 259.5, 405/259.3, 288; 411/15, 19, 20

[56] References Cited

U.S. PATENT DOCUMENTS 4,139,323 2/1979 Brandstetter .
4,423,986 1/1984 Skogberg .
4,459,067 7/1984 Skogberg et al. ..... 405/259.3
4,511,289 4/1985 Herron ..... 405/259.3
4,954,017 9/1990 Davis et al. ..... 405/259.3

FOREIGN PATENT DOCUMENTS 2749068 5/1979 Germany .

*Primary Examiner*—Tamara L. Graysay
*Assistant Examiner*—Frederick L. Lagman
*Attorney, Agent, or Firm*—Mark P. Stone

[57] ABSTRACT

A tubeformed rock bolt having a closed cross section includes a tube (11) provided with a longitudinal depression (12). First and second sleeves are provided at the ends of the tube, and the sleeves are welded to the tube so that a closed compartment is formed. The second sleeve has a radial groove for providing a desired angular position to the rock bolt and a tool used for setting the bolt, and a first hole for injection of cement. The tube is additionally provided with a second hole near a first end for venting the closed compartment.

2 Claims, 3 Drawing Sheets

TUBEFORMED ROCK BOLT

BACKGROUND OF THE INVENTION

The present invention relates to a tubeformed rock bolt with closed cross section. The rock bolt according to the invention is intended to be expanded into contact with the rock by means of cement or other comparatively viscous material.

It has for a long time been a desire to expand tubeformed rock bolts with cement in order to achieve a bolt which can stand higher shearing forces. With a prior art tubeformed rock bolt, see U.S. Pat. No. 4,423,986, it has turned out to be difficult to use cement for expansion of the bolt since one gets cement about the bolt end so that difficulties arise when taking away the setting tool after the bolt has been set. Furthermore, one has obtained an entrapped air volume which after the bolt has been set has pressed out a part of the cement which was used at the expansion of the bolt.

SUMMARY OF THE INVENTION

The present invention, which is defined in the appended claims, aims at solving the above mentioned problems by forming the rock bolt so that one avoids that the cement accumulates about the bolt end and by seeing to it that the cement is not pressed out from the rock bolt when it is set.

A further advantage with the present invention is that the protection against corrosion of the bolt is improved because cement during expansion of the bolt forces its way out through a venting hole near the end of the rock bolt being innermost in the bore hole so that a plug of cement is created about the top of the bolt. This considerably decreases, or prevents, the amount of water that trickles along the outside of the bolt.

DESCRIPTION OF THE PREFERRED EMBODIMENT OF THE INVENTION

Figure 1:
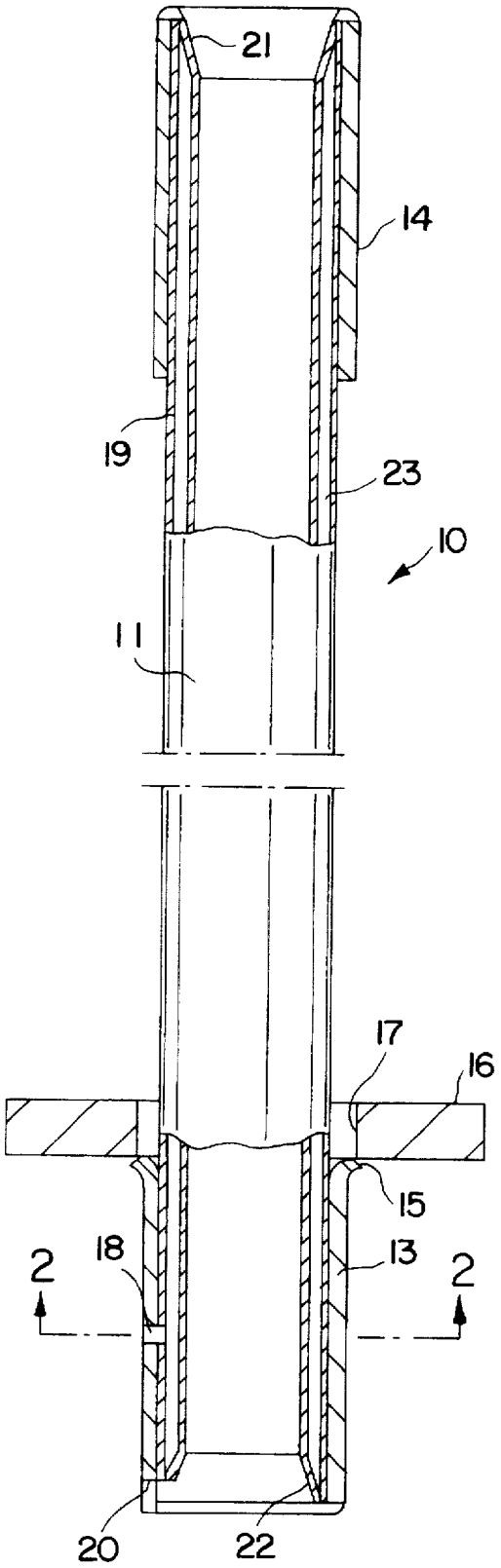
FIG. 1 shows a tubeformed rock bolt according to the invention.
Figure 2:
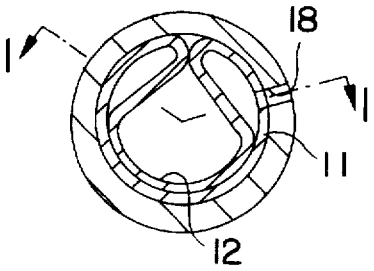
FIG. 2 shows a section as seen along directional arrows 2—2 of FIG. 1.
Figure 3:
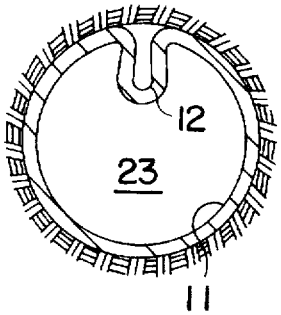
FIG. 3 shows a section through the rock bolt after expansion in a bore hole.
Figure 4:
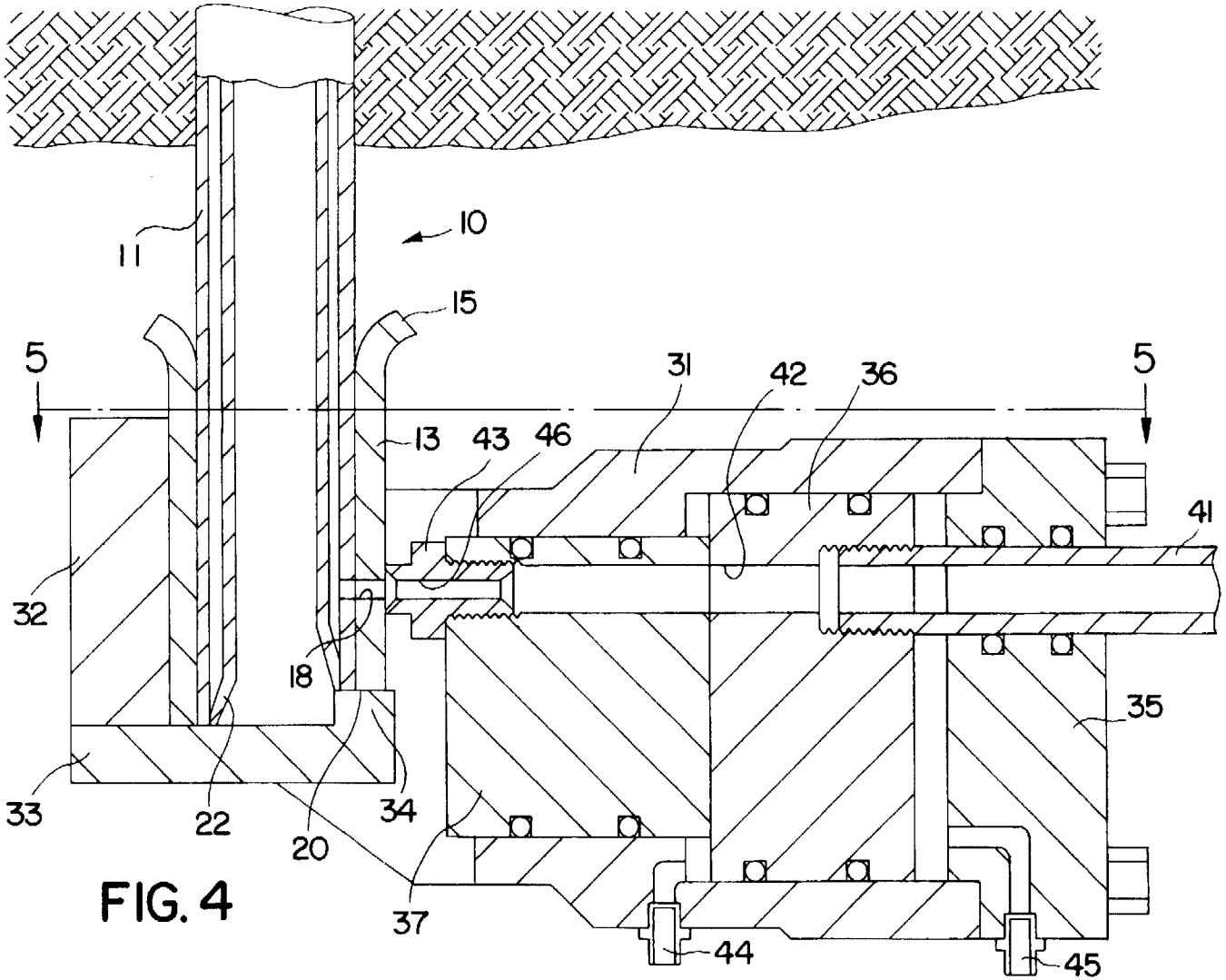
FIG. 4 shows a section through part of the rock bolt and part of a tool for setting the bolt.
Figure 5:
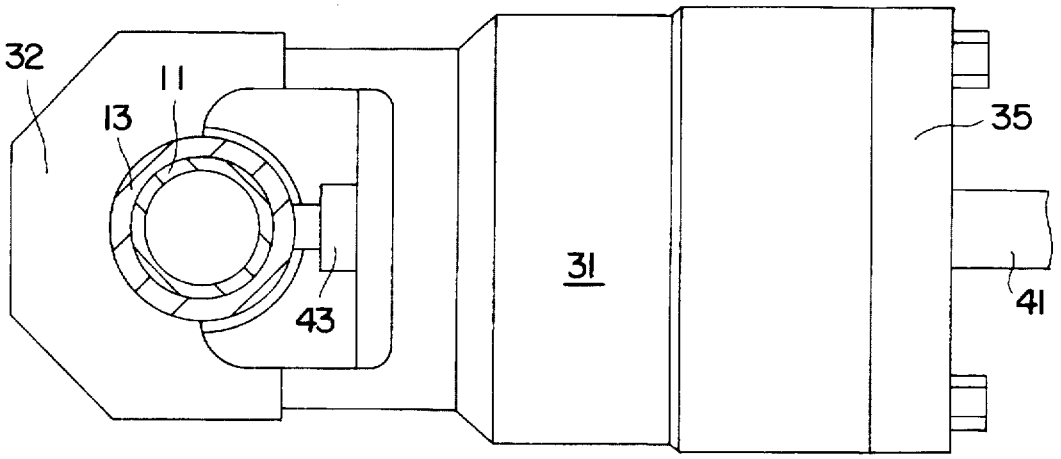
FIG. 5 shows a view taken along directional arrows 5—5 of FIG. 4.

The tubeformed rock bolt 10 shown in FIGS. 1–3 comprises a tube 11 which in the manufacturing has been provided with a longitudinal depression 12 along a part of its length, preferably along all the length. The bolt has a first end 21 which is surrounded by a first sleeve 14 and a second end 22 which is surrounded by a second sleeve 13. The sleeves 13 and 14 are welded to the tube 11 so that an enclosed room 23 is created. A hole 18 connecting the room 23 with the surroundings extends through the second sleeve 13 and the tube 11. The tube 11 is furthermore provided with a second hole 19 near the first end 21 of the tube 11. This hole, which is a venting hole for letting our air from the room 23 when the bolt is expanded, is suitably arranged in the tube 11 at some distance from the sleeve 14. The sleeve 13 is provided with a flange 15 which forms a support for a washer 16 which is intended for contacting the rock when the bolt has been set. The washer 16 is provided with a hole 17 which has a larger diameter than the sleeve 14 but a smaller diameter than the flange 15 so that the washer can be mounted on the bolt before the setting of the bolt. The sleeve 13 is provided with orientation means in form of a radial groove 20 by means of which the rock bolt is given a defined angular position in a tool for setting the bolt.

The tool shown in FIGS. 4–7 for setting the rock bolt 10 comprises a housing 31 provided with a cover 35 screwed to the housing. The housing 31 comprises a dolly 32 against which the rock bolt 10 can be pressed. The dolly 32 is provided with a support 33 for the rock bolt. The support 33 is provided with a projection 34 for cooperation with the groove 20 in the sleeve 13 on the rock bolt. Two pistons 36 and 37 are slidably arranged in the housing 31. The pistons are in a suitable way connected with each other and can of course be made in one piece. A channel 42 extends through the pistons. A tube 41 for supply of cement is connected to the channel 42. In the other end of the channel 42 a nozzle 43 is arranged. The nozzle 43 is provided with a channel 46 and a hardened sharp edge 51. The pistons 36, 37 are moved in the housing 31 by supplying pressure liquid through one of the connections 44, 45.

Figure 6:
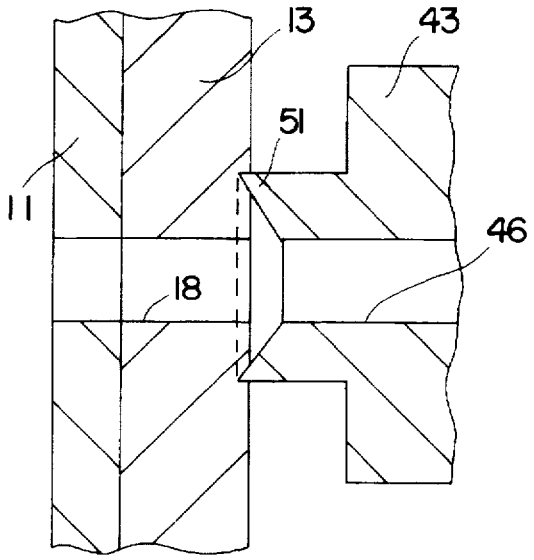
FIG. 6 shows the manner in which a tool and the rock bolt cooperate during expansion of the rock bolt.
Figure 7:
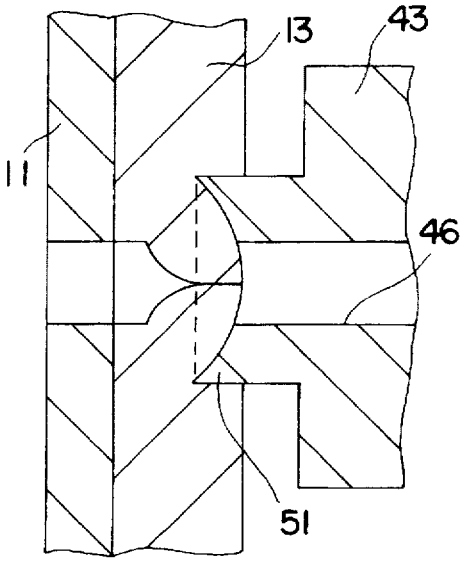
FIG. 7 shows the manner in which a tool and the rock bolt cooperate after the expansion of the rock bolt has been completed.

A rock bolt according to the invention is set in the following way. A bolt 10 is placed on the support 33 and turned so that the projection 34 fits into the groove 20, through which the angular position of the bolt is defined relative to the support 33. After this pressure liquid, e.g. hydraulic oil is supplied through connection 45. The pressure is then of the order of 80 bar. The sharp edge 51 enters into the sleeve 13 as shown in FIG. 6 so that a seal is obtained around the hole 18. After this the bolt is expanded with cement which is supplied via the channel 46 and the hole 18. During the expansion the bolt is vented through the hole 19 so that no air cushion is created in the bolt. The supply of cement suitably continues until a plug of cement has been created about the end 21 of the bolt. It is advantageous to use a cement which after injection, during the setting, swells. After the expansion the pressure in the connection 45 is increased to about 200 bar. The sharp edge 51 penetrates deeper into the sleeve 13 as shown in FIG. 7. Through this the hole 18 is closed so that cement does not flow out of the bolt. The pistons 36, 37 are then moved to the right in FIG. 4 through pressurizing the connection 44.

We claim:

1. Tubeformed rock bolt with closed cross section comprising a tube (11) provided with a longitudinal depression (12) along at least a part of its length, a first sleeve (14) surrounding the tube at a first end (21) of the tube, a second sleeve (13) surrounding the tube at a second end (22) of the tube and a first hole (18) through said second sleeve (13) and said tube (11) for connecting a closed room (23), confined by the rock bolt, with the surroundings, characterized in that the rock bolt near the second end (22) of the tube (11) is provided with orientation means (20) for giving the rock bolt a predetermined angular position in a tool and that the rock bolt near the first end (21) of the tube (11) is provided with a second hole (19) which connects said closed room (23) with the surroundings.

2. Tubeformed rock bolt according to claim 1, characterized in that said orientation means is a radial groove (20) in the second end (22) of the rock bolt.

* * * * *